United States Patent [19]

Winberg et al.

[11] Patent Number: 4,898,261

[45] Date of Patent: Feb. 6, 1990

[54] WATER COOLED PLASTIC OIL PAN

[75] Inventors: Arvid E. Winberg, Fond du Lac; James N. Gavriles, Oshkosh, both of Wis.

[73] Assignee: Brunswick Corporation, Skokie, Ill.

[21] Appl. No.: 335,232

[22] Filed: Apr. 10, 1989

[51] Int. Cl.[4] ..... F01M 5/00

[52] U.S. Cl. ..... 184/6.22; 184/104.3; 123/195 C; 123/196 AB

[58] Field of Search ..... 184/6.22, 104.3; 123/195 C, 196 AB

[56] References Cited

U.S. PATENT DOCUMENTS

| | | | |
|---|---|---|---|
| 1,365,438 | 1/1921 | Adamson | 184/104.3 |
| 1,761,942 | 6/1930 | Strickland | 123/196 AB |
| 2,487,215 | 11/1949 | Blatt | 184/104.3 |
| 3,134,371 | 5/1964 | Crooks . | |
| 3,817,354 | 6/1974 | Weiners | 184/104.3 |
| 4,101,003 | 7/1978 | Timour et al. | 123/195 C |
| 4,434,756 | 3/1984 | Nilsson et al. | 123/195 R |
| 4,610,229 | 9/1986 | Wissmann et al. | 123/195 C |
| 4,768,492 | 9/1988 | Wichmer et al. . | |

OTHER PUBLICATIONS

Mercury Marine Service Training Notebook 90-90593 5-1286, Brunswick Corp., pp. 127-132, 1986.

*Primary Examiner*—Carroll B. Dority
*Attorney, Agent, or Firm*—Robert C. Curfiss

[57] ABSTRACT

A plastic oil pan (16) for an internal combustion engine (14) has an upper lip (18) for mating with the engine in sealing relation, sidewalls (21-24) depending downwardly below the lip, a bottom (26) extending between the sidewalls below the lip to provide a closed-bottom receptacle for holding engine oil, and a plurality of reinforcing walls (28, 30, 36, 38, 40) integrally formed along the sidewalls and increasing the mechanical strength of same to enable the plastic oil pan to support the engine when the latter rests on the oil pan during installation or repair procedures. A conduit (54) extends through the oil pan and passes engine coolant therethrough to cool the engine oil. Particular oil pan and conduit structure is disclosed.

13 Claims, 5 Drawing Sheets

WATER COOLED PLASTIC OIL PAN

BACKGROUND AND SUMMARY

The invention relates to oil pans for internal combustion engines.

The invention provides improvements in oil pan construction, including a plastic oil pan with reinforcing structure increasing the mechanical strength of same to enable a plastic oil pan to support the engine when the latter rests on the oil pan during installation or repair procedures.

The invention also provides improvements in engine cooling. A conduit extends through the oil pan and passes engine coolant therethrough to cool engine oil.

DETAILED DESCRIPTION

Figure 1:
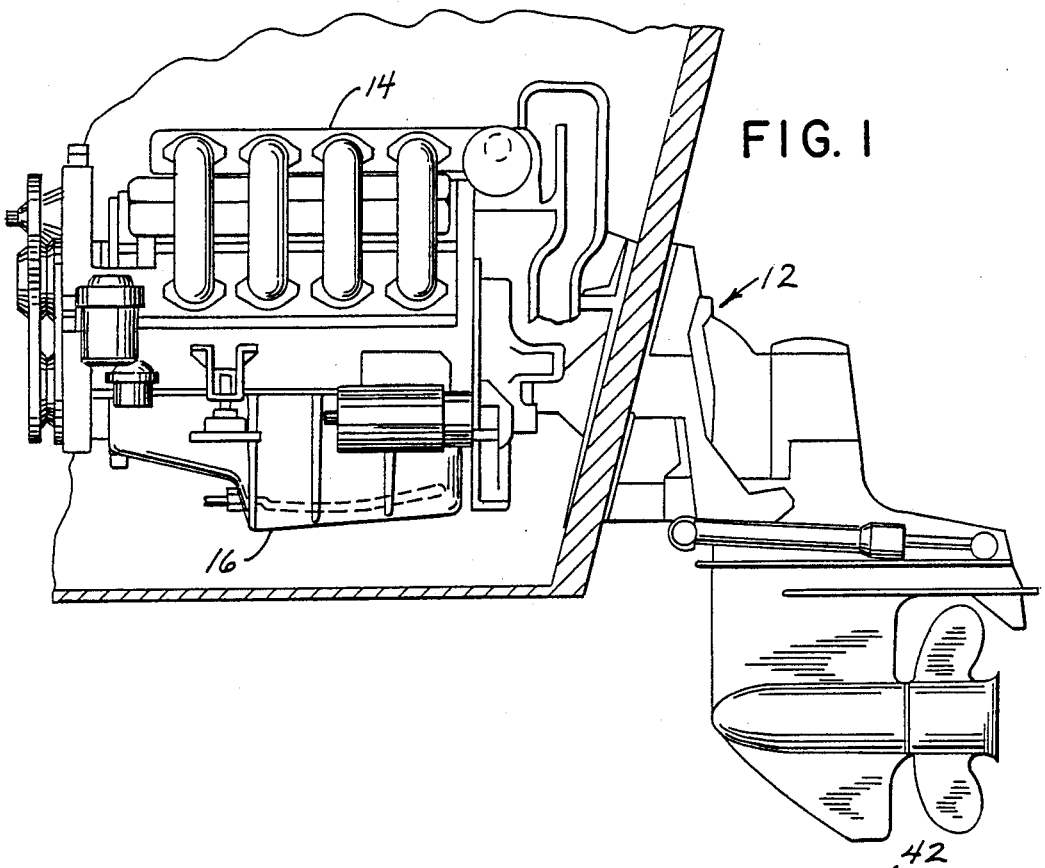
FIG. 1 shows a marine drive having an internal combustion engine with an oil pan in accordance with the invention.
Figure 4:
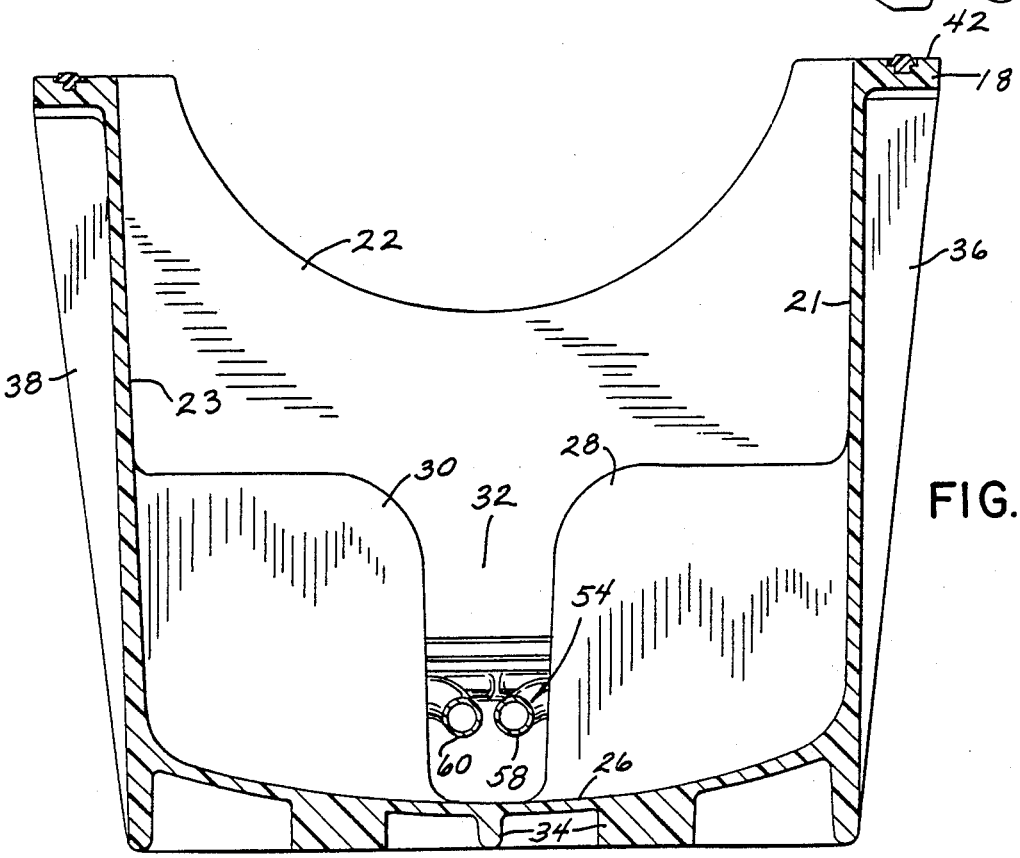
FIG. 4 is a sectional view taken along line 4—4 of FIG. 3.

FIG. 1 shows a marine drive 12 having an internal combustion engine 14 with a lower oil pan 16. Oil pan 16 is a plastic member having an upper lip 18, FIGS. 2–6, for mating with the engine in sealing relation, sidewalls 21, 22, 23, 24 extending downwardly below lip 18, and a bottom 26 extending between the sidewalls below the lip to provide a closed-bottom receptacle for holding engine oil. A plurality of internal reinforcing walls are integrally formed along the internal surface of respective longitudinal sidewalls 21 and 23 and increase the mechanical strength of the sidewalls to enable the plastic oil pan to support the engine when the latter rests on the oil pan during installation or repair procedures. Reinforcing walls 28 and 30 extend laterally inwardly from respective sidewalls 21 and 23 and substantially protrude into the interior of oil pan 16. Reinforcing walls 28 and 30 extend integrally upwardly from bottom 26, such that each reinforcing wall has a given width and height extending in a plane transverse to its respective sidewall. Reinforcing walls 28 and 30 are coplanar and extend toward eachother and have a gap 32 therebetween permitting oil flow therethrough. The reinforcing walls also provide baffle walls preventing rapid flow of oil therepast, which is desirable in marine applications to prevent sloshing of oil back and forth during turbulent operating conditions. The height of reinforcing walls 28 and 30 is less than the height of sidewalls 21 and 23.

Sidewalls 21–24, including opposed longitudinal sidewalls 21 and 23, and opposed lateral sidewalls 22 and 24, extend downwardly below bottom 26 such that when the oil pan and engine rest on a horizontal surface, the sidewalls support and space the bottom 26 of the oil pan above the surface, such that the weight of the engine is supported by the sidewalls of the oil pan. A plurality of legs 34 extend integrally downwardly from bottom 26 in a gridwork or waffle pattern for engaging the horizontal support surface and spacing the bottom 26 of the oil pan above such surface and helping to support the weight of the engine.

Reinforcing walls are also provided by a plurality of external struts such as 36, 38, 40 integrally formed along the exterior surface of respective sidewalls and extending laterally outwardly therefrom and extending from upper lip 18 downwardly along the sidewalls. The external integral struts are tapered along their length to have their narrowest width at the bottom of the sidewalls and their widest width at the top of the sidewalls. The struts further increase the mechanical strength of the sidewalls to enable the plastic oil pan to support the engine when the latter rests on the oil pan during installation or repair procedures.

Figure 10:
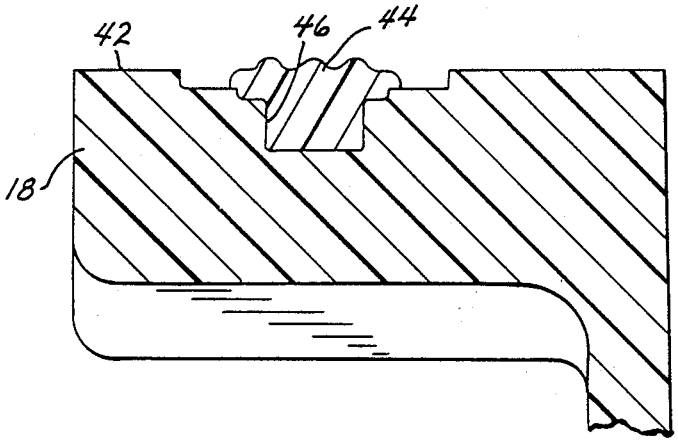
FIG. 10 is an enlarged view of a portion of FIG. 4.

Upper lip 18 of the oil pan includes a horizontal flange having an upper surface 42 with a raised rib 44, FIG. 10, formed thereon for mating with the engine in sealing relation to form a gasket, without the need for a separate gasket. Oil pan 16 is formed in a first molding operation. In a second molding operation, rib 44 is molded in situ in groove 46 in flange 18 of the oil pan. Flange 18 has a plurality of bolt holes therethrough, such as 48, FIG. 2. Rib 44 comprises a plurality of annuli such as 50, each circumscribing a respective bolt hole, and a plurality of connecting sections such as 52, each between respective adjacent annuli.

Figure 2:
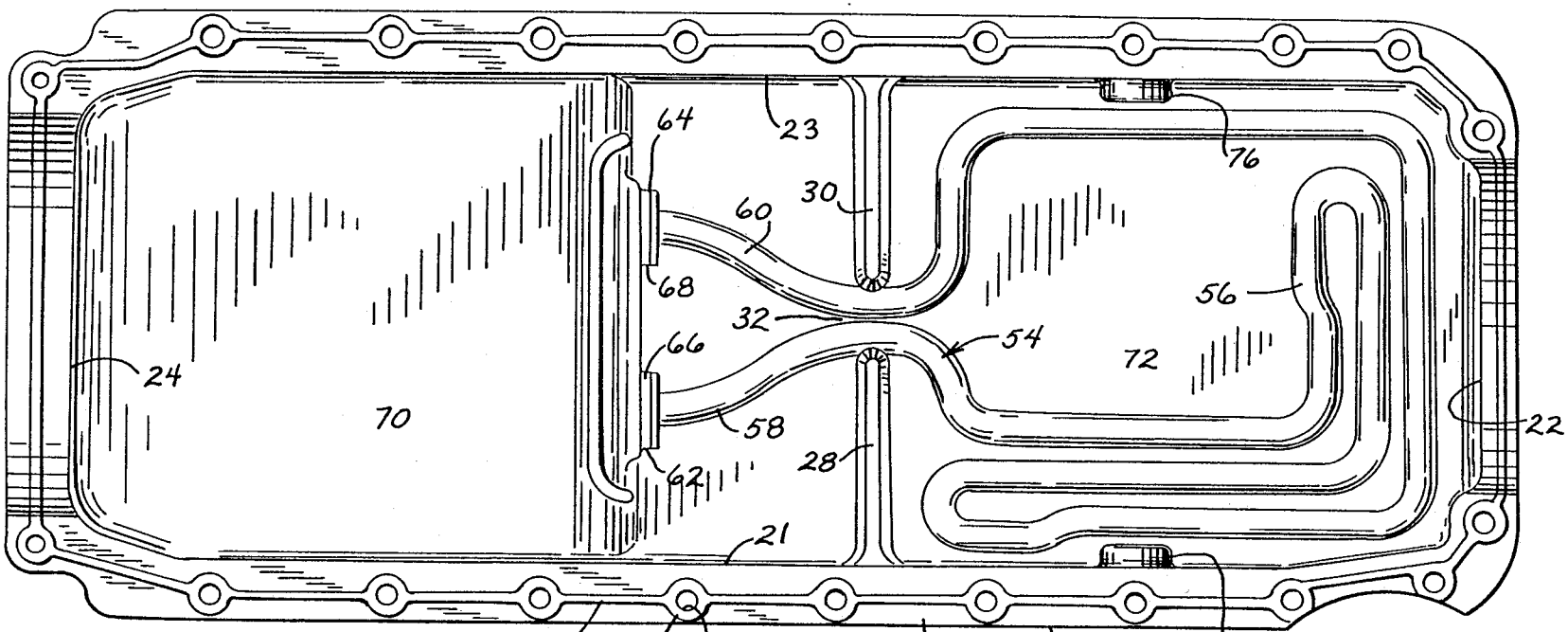
FIG. 2 is a top elevation view of the oil pan of FIG. 1 removed from the engine.
Figure 3:
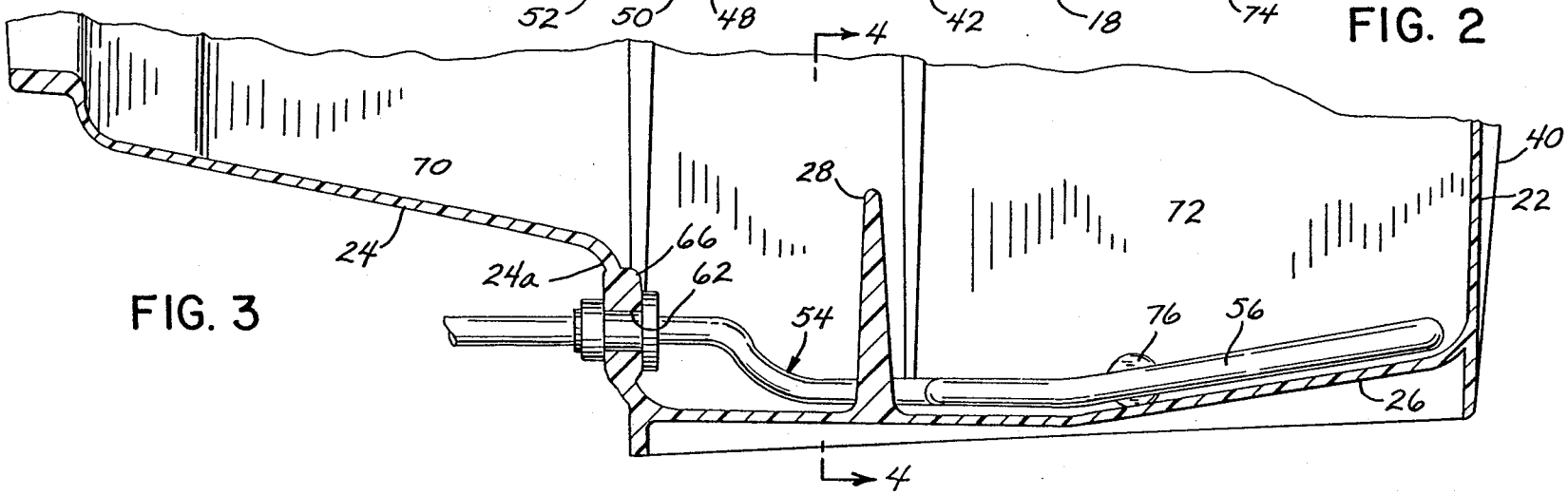
FIG. 3 is a side sectional view of the oil pan of FIG. 1.
Figure 5:
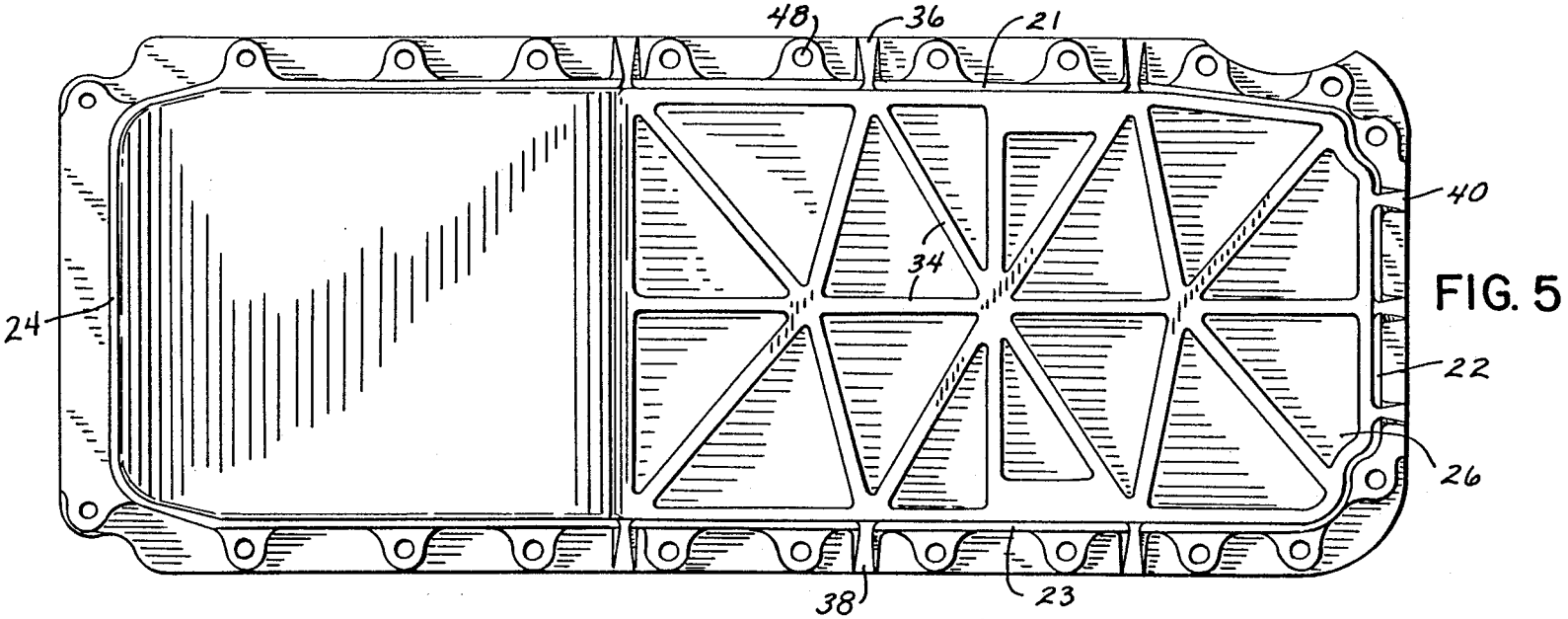
FIG. 5 is a bottom elevation view of the oil pan of FIG. 1.
Figure 6:
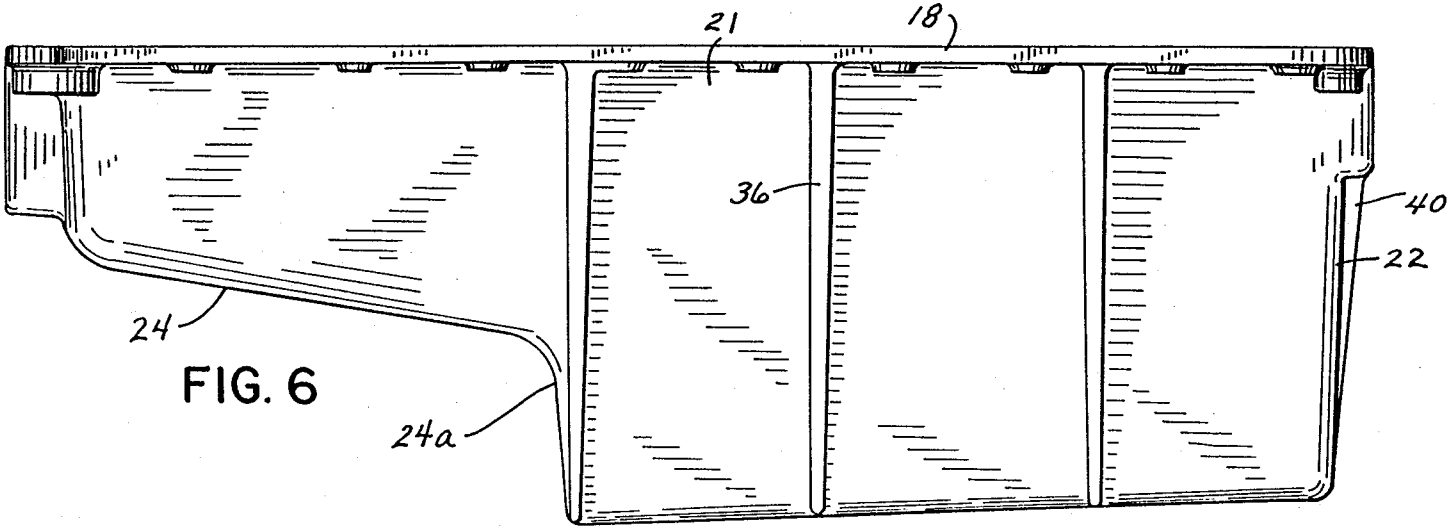
FIG. 6 is a side elevation view of the oil pan of FIG. 1.
Figure 7:
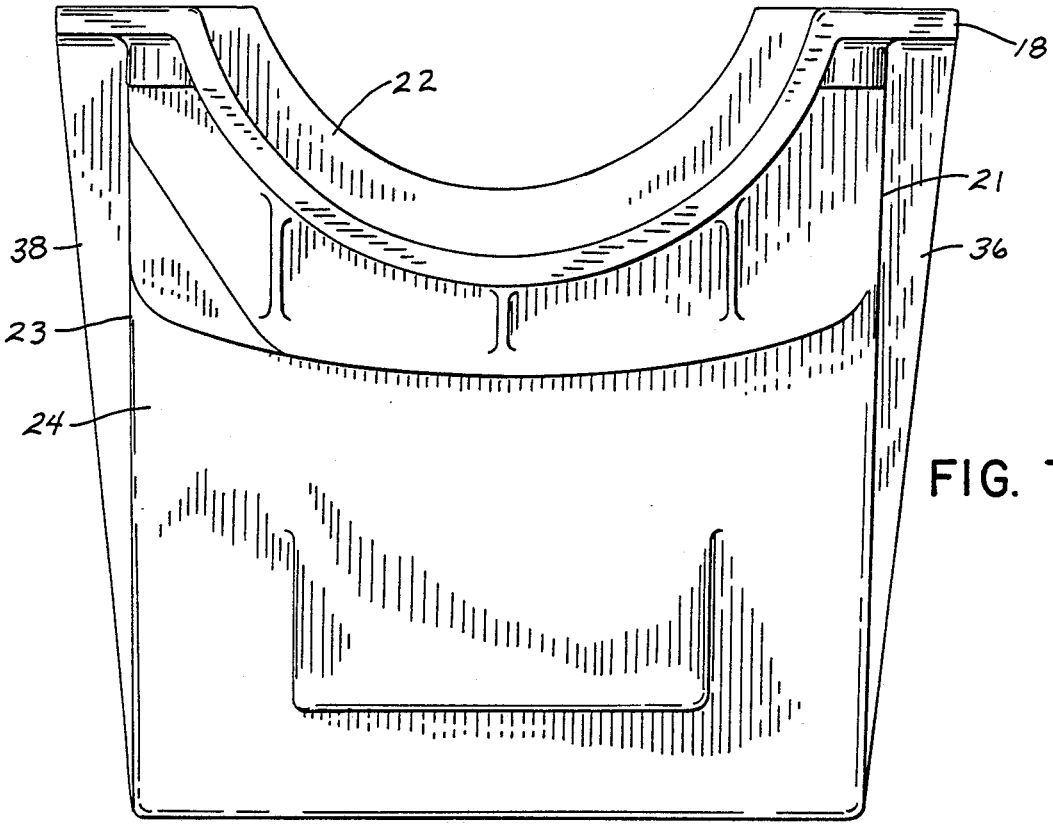
FIG. 7 is a left end elevation view of the oil pan of FIG. 6.
Figure 8:
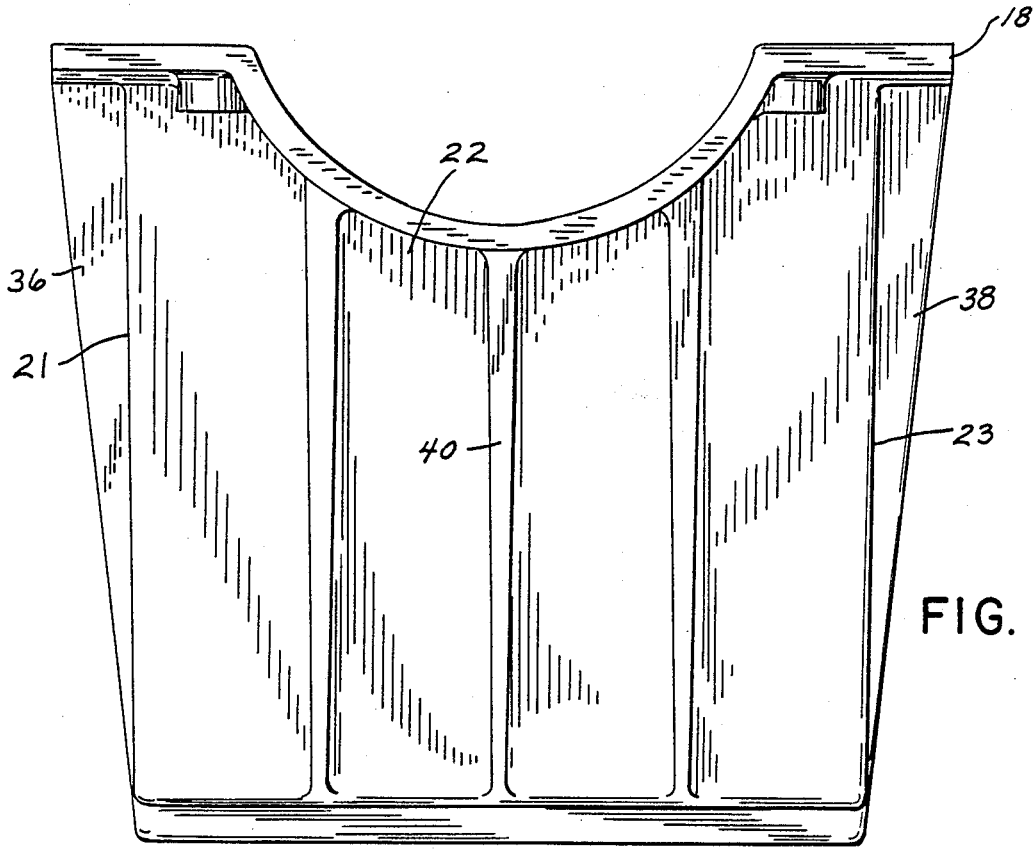
FIG. 8 is a right end elevation view of the oil pan of FIG. 6.

A conduit 54, FIGS. 2 and 3, extends through oil pan 16 and passes engine coolant therethrough to cool engine oil. Conduit 54 extends in a serpentine pattern as shown at 56 along a generally horizontal plane substantially conforming to the bottom 26 of the oil pan. Reinforcing walls 28 and 30 have the above noted gap 32 therebetween, through which conduit 54 extends. Conduit 54 has an inlet portion 58 extending through gap 32 and engaging reinforcing wall 28, and an outlet portion 60 extending through gap 32 and engaging reinforcing wall 30. The central portion of the conduit is provided by serpentine portion 56 on the right side of walls 28 and 30. Inlet and outlet conduit portions 58 and 60 extend through oil pan sidewall 24 and are on the left side of reinforcing walls 28 and 30. Inlet and outlet conduit portions 58 and 60 extend through respective apertures 62 and 64 in the oil pan sidewall, and the sidewall is formed and molded with increased stock thickness 66 and 68 around apertures 62 and 64 to enhance support of inlet and outlet conduit portions 58 and 60. Oil pan 16 has a shallow portion 70 and a deep portion 72. Lateral sidewall 24 provides the bottom of shallow portion 70, and sidewall portion **24*a* provides the transition between shallow portion 70 and deep portion 72. Inlet and outlet conduit portions 58 and 60 extend through sidewall portion 24*a*, such that conduit 54 is in deep portion 72. Drain plugs 74 and 76 are provided in deep portion 72 for draining engine oil. In one possible alternate embodiment, conduit 54** has fins extending from or along one or more sections thereof.

Figure 9:
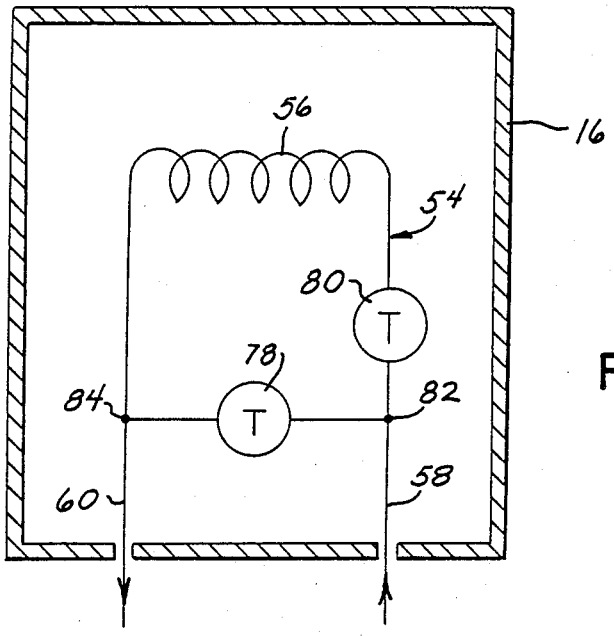
FIG. 9 schematically shows a further embodiment of the invention.

Serpentine portion 56 of conduit 54 provides the central portion of the conduit and does the bulk of the cooling. One or more thermostats 78 and 80, FIG. 9, are provided in conduit 54, and have a first condition passing coolant from inlet portion 58 directly to outlet portion 60, and have a second condition passing coolant from inlet portion 58 to central portion 56. Thermostats 78 and 80 are in the oil pan 16 and respond to the temperature of the engine oil therein, such that at low oil temperature during cold engine operation, engine coolant flows from inlet portion 58 to outlet portion 60 and bypasses central portion 56 such that the latter does not cool the engine oil and hence allows the temperature of the engine oil to rise. At higher engine oil temperature after the engine is warmed up, coolant flows from inlet portion 58 through central portion 56 to outlet portion 60, such that central portion 56 cools the engine oil in oil pan 16. Thermostat 78 is connected between inlet portion 58 and outlet portion 60 in parallel with central portion 56. Thermostat 80 is connected in series with central portion 56 between central portion 56 and the junction 82 of thermostat 78 with inlet portion 58, or between central portion 56 and the junction 84 of thermostat 78 with outlet portion 60. Thermostat 78 is open at low oil temperature, and closed at high oil temperature. Thermostat 80 is closed at low oil temperature and open at high oil temperature. It is preferred that the engine coolant be obtained from the output of the sea water pick-up pump, for example at output line 12 of pump 14 in Widmer et al U.S. Pat. No. 4,768,492, incorporated herein by reference, or from thermostat 16 in said Widmer patent, though other sections of the engine cooling system may be tapped into as convenient, for example Mercury Marine Service Training Notebook 90-90593 5-1286, Brunswick Corp., pp. 127–132, 1986.

It is recognized that various equivalents, alternatives and modifications are possible within the scope of the appended claims.

We claim:

1. An oil pan for an internal combustion engine, said oil pan comprising a plastic member having an upper lip for mating with said engine in sealing relation, sidewalls depending downwardly below said lip, a bottom extending between said sidewalls below said lip to provide a closed-bottom receptacle for holding engine oil, a plurality of reinforcing walls integrally formed along said sidewalls and increasing the mechanical strength of same to enable said plastic oil pan to support said engine when the latter rests on said oil pan during installation or repair procedures, wherein said reinforcing walls are external to said oil pan and formed along the exterior surface of respective said sidewalls and comprise a plurality of struts extending laterally outwardly from respective said sidewalls and extending from said upper lip downwardly along said sidewalls, wherein said sidewalls extend downwardly below said bottom of said oil pan such that when said oil pan and engine rest on a given surface, said sidewalls support and space said bottom of said oil pan above said surface such that the weight of said engine is supported by said sidewalls of said oil pan, and wherein said struts extend along the exterior of said sidewalls to the bottom of said sidewalls and are tapered to have their narrowest width at the bottom of said sidewalls and their widest width at the top of said sidewalls at said upper lip.

2. An oil pan for an internal combustion engine, said oil pan comprising a plastic member having an upper lip for mating with said engine in sealing relation, sidewalls depending downwardly below said lip, a bottom extending between said sidewalls below said lip to provide a closed-bottom receptacle for holding engine oil, a plurality of reinforcing walls integrally formed along said sidewalls and increasing the mechanical strength of same to enable said plastic oil pan to support said engine when the latter rests on said oil pan during installation or repair procedures, wherein said upper lip of said oil pan comprises a flange having an upper surface with a raised rib formed thereon mating with said engine in sealing relation to form a gasket, without the need for a separate gasket, wherein said flange has a plurality of bolt holes therethrough, and wherein said rib comprises a plurality of annuli, each circumscribing a respective said bolt hole, and a plurality of connecting sections, each between respective adjacent said annuli.

3. An internal combustion engine having an oil pan holding engine oil and a conduit extending through said oil pan and passing engine coolant therethrough to cool said oil, wherein said oil pan has internal reinforcing walls increasing the mechanical strength of said oil pan, said internal reinforcing walls being in a common plane and forming a gap to hold said conduit in place in said oil pan.

4. The invention according to claim 3 wherein said reinforcing walls comprise a pair of reinforcing walls extending toward each other from opposite sides of said oil pan and having a gap therebetween through which said conduit extends.

5. The invention according to claim 4 wherein said conduit has an inlet portion extending through said gap and engaging one of said reinforcing walls, and an outlet portion extending through said gap and engaging the other of said reinforcing walls.

6. The invention according to claim 5 wherein said conduit has a serpentine portion on one side of said reinforcing walls, and wherein said inlet and outlet portions of said conduit extend through said gap and through a sidewall of said oil pan on the opposite side of said reinforcing walls.

7. An internal combustion engine having an oil pan holding engine oil and a conduit extending through said oil pan and passing engine coolant therethrough to cool said oil, wherein said oil pan is a plastic member having an upper lip mating with said engine, sidewalls depending downwardly below said upper lip, and a bottom extending between said sidewalls to form a closed-bottom receptacle for holding engine oil, said conduit has an inlet portion and an outlet portion each extending through respective apertures in said oil pan, said oil pan being formed with increased stock thickness around said apertures to enhance support of said inlet and outlet conduit portions.

8. The invention according to claim 7 wherein said apertures are formed in one of said sidewalls of said oil pan.

9. The invention according to claim 8 wherein said oil pan has a shallow portion and a deep portion, and wherein said last mentioned sidewall provides the transition between said shallow portion and said deep portion, said inlet and outlet conduit portions extending through said last mentioned sidewall such that said conduit is in said deep portion.

10. An internal combustion engine having an oil pan holding engine oil and a conduit extending through said oil pan and passing engine coolant therethrough to cool said oil, wherein said conduit has an inlet portion, an outlet portion, and a central portion between said inlet and outlet portions, said central portion providing the bulk of said cooling, and wherein said conduit has a bypass portion between said inlet and outlet portions in parallel with said central portion, thermostat means in said conduit having a first condition passing coolant from said inlet portion through said bypass portion to said outlet portion, and having a second condition passing coolant from said inlet portion through said central portion to said outlet portion.

11. The invention according to claim 10 wherein said thermostat means is in said oil pan and responds to the temperature of the engine oil therein such that at low oil temperature during cold engine operation, coolant flows from said inlet portion through said bypass portion to said outlet portion and bypasses said central portion such that the latter does not cool the engine oil and hence allows the temperature of said engine oil to rise, and such that at higher oil temperature, coolant flows from said inlet portion through said central portion to said outlet portion such that said central portion cools said engine oil.

12. The invention according to claim 11 wherein said thermostat means comprises a first thermostat connected between said inlet portion and said outlet portion in said bypass portion in parallel with said central portion, and a second thermostat connected in series with said central portion, said first thermostat being open at low oil temperature and closed at high oil temperature, said second thermostat being closed at low oil temperature and open at high oil temperature.

13. The invention according to claim 12 wherein said second thermostat is connected between said central portion and the junction of said bypass portion with one of said inlet and outlet conduit portions.

* * * * *